United States Patent [19]

Hein

[11] 3,956,969

[45] May 18, 1976

[54] HYDROSTATIC PUMP INCLUDING SEPARATE NOISE REDUCING VALVE ASSEMBLIES FOR ITS INLET AND OUTLET PRESSURE PORTS

[75] Inventor: Allyn J. Hein, Joliet, Ill.

[73] Assignee: Caterpillar Tractor Co., Peoria, Ill.

[22] Filed: Dec. 9, 1974

[21] Appl. No.: 531,017

[52] U.S. Cl. ..... 91/6.5; 91/487

[51] Int. Cl.[2] ..... F01B 13/04

[58] Field of Search ..... 91/6.5, 499, 506

[56] References Cited

UNITED STATES PATENTS

| | | | |
|---|---|---|---|
| 2,963,983 | 12/1960 | Wiggermann | 91/6.5 |
| 3,157,130 | 11/1964 | Cadiou | 91/6.5 |
| 3,199,461 | 8/1965 | Wolf | 91/506 |
| 3,200,761 | 8/1965 | Firth et al. | 91/6.5 |
| 3,208,397 | 9/1965 | Lehrer et al. | 91/6.5 |
| 3,382,813 | 5/1968 | Schauer | 91/506 |
| 3,585,901 | 6/1971 | Moon | 91/499 |

*Primary Examiner*—William L. Freeh
*Attorney, Agent, or Firm*—Phillips, Moore, Weissenberger, Lempio & Strabala

[57] ABSTRACT

In order to reduce noise and erosion within a hydrostatic translating unit having a reversible mode of operation, preferably a pump, of the type having a cylinder barrel defining a plurality of piston bores with the cylinder barrel being rotatable relative to a cylinder head for periodically communicating the piston bores with first and second pressure ports or passages, a restrictive orifice and shuttle valve are arranged in parallel communication between each pressure port and an intermediate port positioned for communication with each cylinder bore prior to communication of the cylinder bore with the respective pressure port.

4 Claims, 3 Drawing Figures

HYDROSTATIC PUMP INCLUDING SEPARATE NOISE REDUCING VALVE ASSEMBLIES FOR ITS INLET AND OUTLET PRESSURE PORTS

BACKGROUND OF THE INVENTION

The present invention relates to a noise and erosion reducing improvement within a reversible hydraulic translating unit. More particularly, the invention is described below having reference to a reversible hydraulic pump of a type suitable for use in a hydrostatic transmission. In such a hydrostatic transmission, power output from a prime mover is transmitted to a driven element by means of fluid pressure within a closed hydraulic loop including both hydrostatic pump and motor. Hydrostatic transmissions of this type are commonly employed in a variety of applications to provide variable fluid transmission between a power source and powered equipment. Both the pump and motor may be capable of variable displacement in order to adjust operating speed for the transmission. The pump unit is also reversible in order to selectively establish direction of operation for the transmission.

Within such a transmission, the pump develops very high fluid pressures which are communicated to the motor within the closed loop. Pistons within both the pump and motor reciprocate between opposite limits of displacement as they are intermittently communicated with multiple pressure ports. As the pistons reach a limit of reciprocable motion and begin to move in the opposite direction, either high fluid pressure or a vacuum may be developed. Upon subsequent communication with one of the ports, fluid tends to flow at a very high rate in order to equalize either the high pressure or vacuum referred to above. This high speed flow of equalizing fluid tends to produce undesirable noise or "knocking" as well as to cause erosion in various parts of the cylinder head and barrel which meter fluid flow between the piston bores and pressure ports.

It has been known in the prior art to employ either check valves or bleed slots to initially relieve high fluid pressure trapped in the cylinder ports just prior to the port entering into communication with an outlet passage in the cylinder head. Although both of these methods suitably reduce noise within the hydrostatic units, they have also been found to exhibit certain deficiencies. For example, when bleed slots are used to initiate communication between the piston bores and pressure ports, they are subject to severe erosion which tends to affect operation of the unit and to add contaminants to the hydraulic fluid, thus contributing to possible premature failure of the hydrostatic translating unit. Similarly, when check valves are employed to equalize pressure in the cylinder ports, they necessarily add a substantial number of components within the unit.

SUMMARY OF THE INVENTION

Accordingly, it is an object of the present invention to overcome one or more of the problems discussed above. In particular, it is an object of the present invention to provide an improved cylinder head for a hydrostatic translating unit in order to minimize or eliminate both undesirable noise and erosion resulting from the flow of high pressure fluid.

In order to accomplish these objects and suitably reduce noise within the hydrostatic unit, it is desirable to prevent a high pressure port from suddenly opening into communication with a cylinder bore with the resulting rush of equalizing fluid flow under high pressure tending to cause considerable noise and particularly eroding any surfaces tending to meter flow of the high pressure fluid. It is further desirable to introduce charging or actuating fluid from a low pressure port into each cylinder bore prior to its communication with the low pressure port in order to eliminate or reduce the development of a vacuum within the bore. Such a vacuum may undesirably cause a similar rush of equalizing fluid flow also tending to cause undesirable noise and erosion.

Within a reversible translating unit, both of these functions may be accomplished by a parallel arrangement of a restrictive orifice and shuttle valve arranged in communication with each of the pressure ports and an intermediate port arranged for communication with each respective piston bore just before the respective piston reaches a limit of reciprocation therein.

Additional objects and advantages of the invention will be made apparent in the following description having reference to the accompanying drawings.

DESCRIPTION OF THE PREFERRED EMBODIMENT

Figure 1:
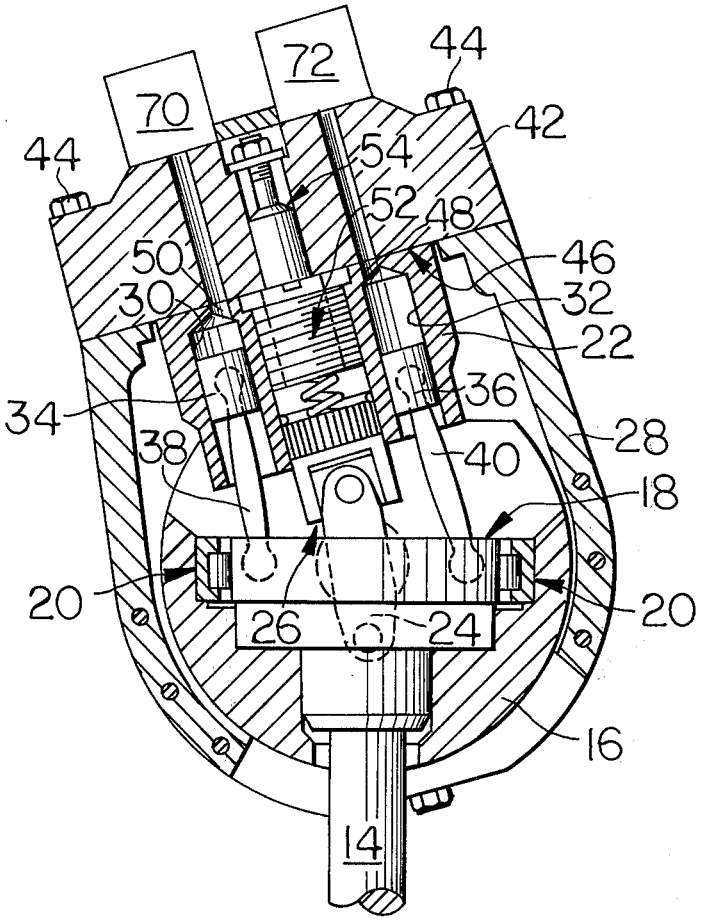
FIG. 1 is a sectioned view of a hydrostatic translating unit, preferrably a reversible pump, suitable for use within a hydrostatic transmission.

Referring now to FIG. 1, a reversible pump of a type suitable for use within a hydrostatic transmission is generally indicated at 12. The pump 12 includes a drive shaft 14 which may be suitably coupled with a prime mover or engine (not shown). The drive shaft 14 is journaled within a stationary housing 16 while being coupled for driving a flange assembly 18 in rotation. The flange assembly 18 is suitably mounted within the stationary housing 16 by means of bearings such as those indicated at 20.

The drive shaft 14 and flange assembly 18 are also coupled in driving engagement with a rotating cylinder barrel 22 by means of a universal joint 26 having a swivel plate 24. Both the stationary housing 16 and the rotating cylinder barrel 22 are arranged within a nonrotating housing 28.

The rotating cylinder barrel forms a plurality of bores such as those indicated at 30 and 32 for respectively receiving reciprocable pistons 34 and 36. The pistons 34 and 36 are respectively coupled with the flange assembly 18 by means of connecting rods indicated at 38 and 40.

Variable displacement for the reversible pump is established by movement or rotation of the nonrotating housing 28 and cylinder barrel 22 out of axial alignment with the drive shaft 14 and flange assembly 18. Accordingly, the pump is illustrated in FIG. 1 at a relative position of maximum displacement. Further, each of the pistons 34 and 36 is illustrated at a limit of reciprocation within its respective bore. For example, the piston 36 is fully retracted into a position commonly referred to as a "bottom dead center". Similarly, the other piston 34 is fully extended into its bore 30 at a position commonly referred to as "top dead center".

A stationary head plate 42 is secured to the non-rotating housing 28 by means of cap screws indicated at 44. The head plate 42 forms a valve face 46 arranged for abutting engagement with the rotating cylinder barrel 22. Each of the piston bores 30 and 32 is in communication with the valve face by means of internal passages 48 and 50.

A spring mechanism 52 and retainer assembly 54 maintain the rotating cylinder barrel in close engagement with the valve face 46 of the stationary head plate 42.

As described in greater detail below, the head plate 42 communicates with respective annular pressure ports circumferentially formed in spaced-apart relation as indicated at 60 and 62 upon the valve face 46 (see FIG. 3). The relative position of the interconnecting passages 48 and 50 for the respective piston bores 30 and 32 are also indicated in phantom on FIG. 3. Either one of the pressure ports 60 or 62 may act as an inlet port filled with relatively low pressure supply fluid for delivery to the bores 30 and 32. The other pressure port concurrently acts as an outlet port experiencing relatively high fluid pressure developed in response to a work load such as the loader (not shown) within a hydrostatic transmission. Assuming that the cylinder barrel 22 (see FIG. 1) is rotating in a direction indicated by an arrow 64 on FIG. 3, then the pressure port 60 would be acting as the high pressure or outlet port while the other pressure port 62 would be acting as the low pressure or inlet port.

Figure 3:
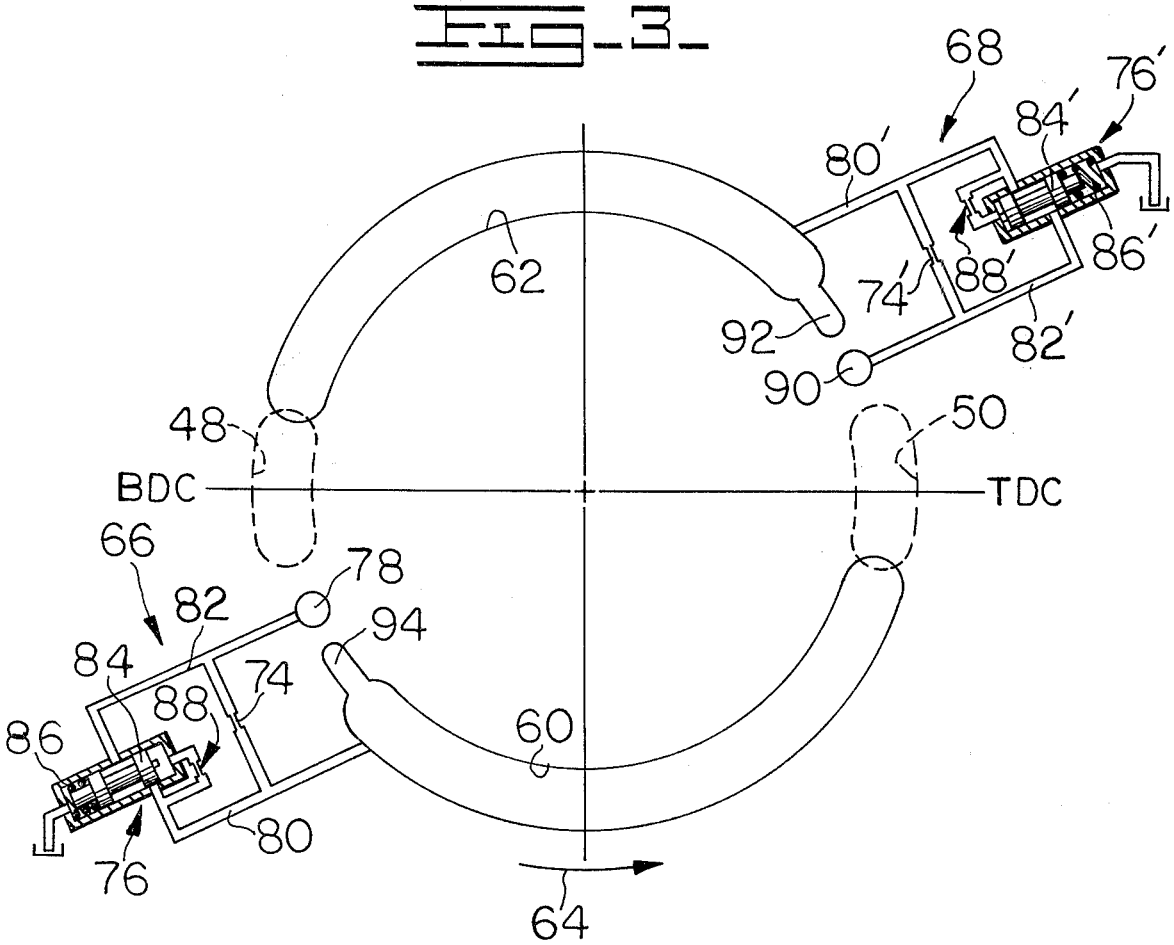
FIG. 3 is schematic representation of a valve face for a stationary cylinder head of a hydrostatic unit and including the noise and erosion reducing valve components of the present invention.

Within the arrrangement described above, as each cylinder port moves past its bottom dead center position as indicated on FIG. 3 by the passage 48, its piston would commence moving upwardly (as viewed in FIG. 1) in order to pressurize hydraulic fluid within the bore 32. However, pressure developed within the bore 32 may not reach the level of pressure developed within the pressure port 60 under the influence of an external load. Accordingly, upon entry of the bore or its passage 48 into communication with the pressure port 60, the considerable difference in pressure would result in a sudden high speed rush of fluid from the pressure port 60 through the passage 48 into the piston bore 32. This resulting high speed rush of fluid would also tend to cause erosion, particularly in those portions of the passage 48 and pressure port 60 initially providing metered communication into the bore 32.

A similar problem develops as each piston bore passes a condition of top dead center (indicated by the interconnecting passage 50 on FIG. 3) toward communication with the low pressure inlet passage 62. As the bore passes the top dead center position, its piston 34 (see FIG. 1) commences retraction under influence of the connection rod 38 causing a vacuum to be developed within the bore 30. Accordingly, a substantial pressure differential may be developed between the piston bore 30 and the inlet pressure passage 62 so that when they enter into communication, a high speed flow of fluid from the inlet passage 62 tends to equalize the vacuum developed within the bore 30. This condition may similarly result in substantial noise and erosion, as described above.

In order to eliminate or minimize both of these problems, the present invention contemplates a noise reducing valve assembly 66 or 68 in association with each of the pressure ports 60 and 62. Each of the valve assemblies 66 and 68 may be arranged within a separate valve assembly housing such as those indicated at 70 and 72 in FIGS. 1 and 2. The housing 70 and 72 may be formed from a special erosion resistant material since they need not be an integral portion of the cylinder head 42.

The valve assembly 66 includes a restrictive orifice 74 and a shuttle valve 76 arranged in parallel communication between the first pressure port 60 and an intermediate port 78 arranged for communication with each piston bore subsequent to its passing the bottom dead center position indicated at 48 and prior to communication of the piston bore with the pressure port 60. The orifice 74 and shuttle valve 76 are in communication with the first pressure port 60 by means of a branched passage or conduit 80 while being in communication with the intermediate ports 78 by means of another branched passage or conduit 82.

The shuttle valve 76 includes a shuttle spool 84 normally positioned by a spring 86 to provide open communication between the conduits 80 and 82. However, the spool 84 tends to be shifted against the spring 86 by relatively high fluid pressure from the pressure port 60 passing through the conduit 80 and an additional restrictive orifice 88.

Figure 2:
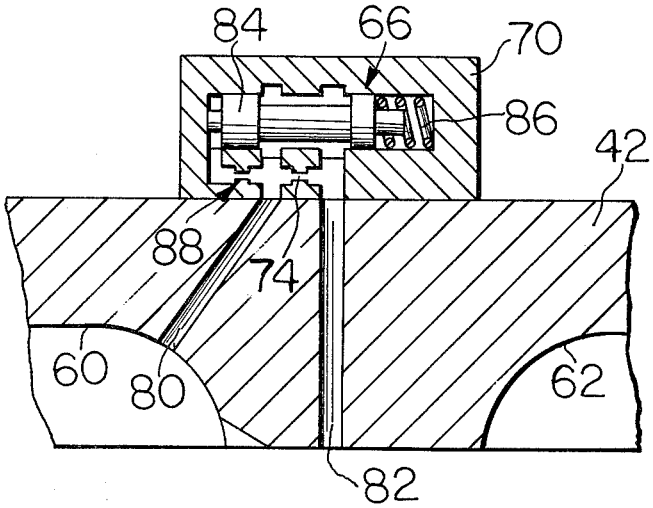
FIG. 2 is an enlarged, fragmentary view, with parts in section, to clearly illustrate a noise and erosion reducing valve assembly constructed according to the present invention.

The other valve assembly 68 is composed of similar elements indicated by similar primed numerals for communicating the second pressure port 62 with an intermediate port 90 arranged for communication with each piston bore as it passes a position of top dead center and prior to communication of the respective piston bore with the pressure port 62. The housing 72 for the valve assembly 68 may be similar to the housing 70 which is illustrated in FIG. 2.

The use of such valve assemblies in conjunction with each of the pressure ports 60 and 62 serves to eliminate or minimize both of the problems outlined above which occur because of the very high pressure developed within the outlet pressure port 60 and because of the vacuum developed within the piston bore as it passes a position of top dead center. The manner in which the valve assemblies 66 and 68 overcome both of these problems regardless of the direction or mode of operation for the pump is described below.

Initially, the shuttle valve 76 is responsive to the very high pressure in the pressure port 60 entering through the restrictive orifice 88 to block communication between the branched passages 80 and 82. Accordingly, the high pressure outlet port 60 is in communication with the intermediate port 78 only by means of the restrictive orifice 74. The restrictive orifice 74 is sized to provide a selected rate of pressure build-up within each of the piston bores as it enters into communication with the intermediate port 78. Thus, the large pressure differential normally existing between the high pressure outlet port 60 and the piston bore represented by the passage 48 is minimized or eliminated.

The shuttle valve 76' of the other assembly 68 is acted upon only by low fluid pressure from the inlet pressure port 62 through the branched passage 80' and the restrictive orifice 88'. Accordingly, its spool 84' remains in an open position so that fluid may freely pass from the inlet port 62 into the respective piston bore through the passage 50. Thus, prior to communication of the passage 50 with the inlet pressure port 62, fluid may be introduced into the piston bore to prevent the development of a vacuum condition.

During high speed operation of the pump, there may be insufficient flow from the pressure port 62 through the shuttle valve 76 to sufficiently reduce a vacuum in the piston bore. Accordingly, a bleed slot 92 is arranged at a leading end of the pressure port 62 for communication with each piston bore subsequent to its passage from communication with the intermediate port 90. Initial flow thereby develops across the valve assembly 68 which is contained within the erosion-resistant housing 72. Subsequently, supplemental flow may pass through the bleed slot 92 in order to sufficiently reduce a vacuum within the piston bore while minimizing the possibility of erosion within the bleed slot itself.

When the direction of operation for the pump is reversed, the pressure port 62 acts as an outlet port experiencing relatively high pressure while the pressure port 60 acts as an inlet port under relatively low pressure. Accordingly, the functions of the shuttle valves are interchanged so that each valve assembly acts in the fashion described above for the other valve assembly. Accordingly, a bleed slot 94 is also arranged at a leading end of thepressure port 60 to permit supplemental flow from the pressure port 60 into each piston bore when the pressure port 60 is acting as a low pressure inlet port.

What is claimed is:

1. In a cylinder head of a type suitable for mounting relative to a rotatable cylinder barrel of a reversible hydraulic pump suitable for use in a hydrostatic transmission, the cylinder barrel forming a plurality of bores for reciprocably mounting respective pistons, the cylinder head forming first and second pressure ports circumferentially arranged in a valve face of the cylinder head for periodic communication with the piston bores, the respective pressure ports containing either high or low pressure fluid depending upon the mode of operation for the translating unit, reciprocation of the pistons being timed in accordance with relative rotation between the cylinder head and the cylinder barrel, the improvement comprising a portion of the cylinder head forming a first restrictive orifice for communicating the first pressure port with the valve face of the cylinder head by means of a first port intermediate the first and second pressure ports, the first intermediate port being positioned for communication with each cylinder bore subsequent to its respective piston reaching a limit of reciprocation within the bore, the first restrictive orifice being selectively sized to control the rate of pressure equalization between each cylinder bore and the first pressure port, the cylinder head also forming a bore for receiving a first shuttle valve means arranged in parallel communication with the first restrictive orifice between the first pressure port and the first intermediate port on the valve face, the first shuttle valve means tending to close in response to a first relatively high pressure in the first pressure port, the cylinder head also forming a similar second restrictive orifice, and second shuttle valve means in parallel communication between the second pressure port and a second port intermediate the second and first pressure ports for communication with each cylinder bore just prior to its respective piston reaching an opposite limit of reciprocation within the bore and further comprising an additional restrictive orifice associated with each shuttle valve means for limiting fluid flow from the respective pressure port to which the shuttle valve means tends to be responsive and a bleed slot formed in communication with each pressure port for communication with each cylinder bore after communication of the cylinder bore with the respective intermediate port.

2. The cylinder head of claim 1 wherein the first and second restrictive orifices and the bores for the first and second shuttle valve means are formed by an erosion-resistant body means.

3. The cylinder head of claim 1 wherein the first and second restrictive orifices and the bores for the first and second shuttle valve means are formed by an erosion-resistant body means.

4. In a hydrostatic pump of a type having a cylinder head mounted relative to a rotatable cylinder barrel, the pump having a reversible mode of operation, the cylinder barrel having a plurality of bores each reciprocably mounting a piston, the cylinder head forming first and second pressure ports circumferentially arranged upon a valve face for periodic communication with the piston bores, the respective pressure ports containing either high or low pressure fluid depending upon the mode of operation for the pump, reciprocation of the pistons being timed in accordance with relative rotation between the cylinder head and the cylinder barrel, the improvement comprising a portion of the cylinder head forming a first restrictive orifice for communicating the first pressure port with the valve face of the cylinder head by means of a first port intermediate the first and second pressure ports, the first intermediate port being positioned for communication with each cylinder bore subsequent to its respective piston reaching a limit of reciprocation with the bore, the first restrictive orifice being selectively sized to control the rate of pressure equalization between each cylinder bore and the first pressure port, the cylinder head also forming a bore for receiving a first shuttle valve means arranged in parallel communication with the first restrictive orifice between the first pressure port and the first intermediate port on the valve face, the first shuttle valve means tending to close in response to relatively high pressure in the first pressure port, the cylinder head also forming a similar second restrictive orifice, and second shuttle valve means in parallel communication between the second pressure port and a second port intermediate the second and first pressure ports for communication with each cylinder bore just prior to its respective piston reaching an opposite limit of reciprocation within the bore, and further comprising an additional restrictive orifice associated with each shuttle valve means for limiting fluid flow from the respective pressure port to which the shuttle valve means tends to respond, a bleed slot being formed in communication with each pressure port for communication with each cylinder bore after communication of the cylinder bore with the respective intermediate port and an erosion-resistant body means forming the first and second restrictive orifices and the bores for the first and second shuttle valve means.

* * * * *